US006696169B1

(12) United States Patent
Röttger et al.

(10) Patent No.: US 6,696,169 B1
(45) Date of Patent: Feb. 24, 2004

(54) EXPANDED METAL MESH AND TOOL FOR PRODUCING THE SAME

(76) Inventors: Wilhelm Röttger, Ruogisesfelderweg 5, D-36358 Herbstein (DE); Albrecht Klöckner, Spreitgen, D-51588 Nuembrecht (DE); Hermann Klöckner, Spreitgen, D-51588 Nuembrecht (DE)

( * ) Notice: Subject to any disclaimer, the term of this patent is extended or adjusted under 35 U.S.C. 154(b) by 0 days.

(21) Appl. No.: 09/914,887

(22) PCT Filed: Dec. 23, 1999

(86) PCT No.: PCT/DE99/04104

§ 371 (c)(1),
(2), (4) Date: Oct. 9, 2001

(87) PCT Pub. No.: WO00/53356

PCT Pub. Date: Sep. 14, 2000

(30) Foreign Application Priority Data

Mar. 5, 1999 (DE) ..... 199 10 312

(51) Int. Cl.[7] ..... B32B 3/10
(52) U.S. Cl. ..... 428/571; 428/596
(58) Field of Search ..... 428/596, 571, 428/572, 600; 52/670, 671, 672

(56) References Cited

U.S. PATENT DOCUMENTS 1,210,849 A * 1/1917 Scammell ..... 52/454
1,437,746 A * 12/1922 Clark ..... 52/671
2,018,085 A * 10/1935 Otte ..... 29/897.15
2,214,247 A * 9/1940 Hawksworth ..... 52/180
2,474,778 A * 6/1949 Cross ..... 52/454
4,280,308 A * 7/1981 Svensson ..... 52/98
6,447,928 B2 * 9/2002 Suitts ..... 428/573

FOREIGN PATENT DOCUMENTS

JP 06-333572 * 12/1994
JP 06-333573 * 12/1994
WO 96/18468 6/1996

OTHER PUBLICATIONS

Patent Abstracts of Japan, vol. 1995, No. 03, Apr. 28, 1995 & JP 06 333572 A, Dec. 2, 1994.

Patent Abstracts of Japan, vol. 1995, No. 3, Apr. 28, 1995 & JP 06 333573 A, Dec. 2, 1994.

* cited by examiner

*Primary Examiner*—John J. Zimmerman
(74) *Attorney, Agent, or Firm*—Smith-Hilleand Bedell

(57) ABSTRACT

The invention relates to expanded metal mesh consisting of mesh webs and nodes and to a tool for producing said expanded metal mesh. At least some of the mesh nodes are configured as predetermined breaking points (8, 9*a*, 9*b*). The expanded metal mesh is produced by a shear blade which has tooth bases of differing depths between the individual teeth on the blade profile.

13 Claims, 6 Drawing Sheets

EXPANDED METAL MESH AND TOOL FOR PRODUCING THE SAME

BACKGROUND OF THE INVENTION

The invention relates to an expanded metal mesh and to a tool for producing same.

Known is an expanded metal mesh comprising an e.g. rhombic or square mesh in the furnished condition, the geometry of which automatically couples expansion lengthwise and contraction crosswise. This known reaction results in such an expanded metal mesh still being difficult to shape to conform to surface areas having pronounced three-dimensional curvature even when the material is itemized, folded or nicked and doubled.

An expanded metal mesh for plastic modelling as a reinforcement inlay for a covering material in the form of curves, webs or strips featuring high conformity to complex three-dimensionally shapes for use e.g. as verge and edge weatherstripping is known from DE 36 42 063. This covering material consists substantially of an elastomeric layer and the expanded metal mesh serving as a reinforcing element. This expanded metal mesh features an expansion of 50 to 150% lengthwise and ≦20% crosswise, each mutually excluding the other, as well as a return ≦5%.

Known from EP 0 797 486 is an expanded metal mesh permitting very good plastic modelling. In this known expanded metal mesh, two nodes staggered from row to row in the mesh are parted by a nick perpendicular to the actual expanded cut. One such expanded metal mesh excels by being excellently conducive to three-dimensional shaping.

Known in conclusion from DE 198 21 574.6 is a means of improving the expansion response of the expanded metal mesh by creating an additional transverse corrugation in the sheet metal by either using trapzoidal or corrugated sheet as the starting material or by producing the transverse corrugation in a flat expanded metal mesh in the course of fabrication, subsequent flat rolling then creating links in the mesh which are bent S-shaped.

The drawback in all of these known expanded metal meshes is that they do not permit cost-effective manufacture, they also being more difficult to handle than normal expanded metal mesh.

The invention is thus based on the objective of providing an expanded metal mesh for cost-effective manufacture whilst permitting expansion in two directions or at least no crosswise contraction in the presence of lengthwise expansion. A further objective of the invention is to provide a tool for cost-effective manufacture of expanded metal mesh.

SUMMARY OF THE INVENTION

The expanded metal mesh in accordance with the invention is characterized by it being cut, for example, so that certain links remain joined merely ultrathin, resulting in some of the nodes in the mesh being configured as designed break points. Now, manufacture is the same as for normal expanded metal mesh and the resulting expanded metal mesh can be handled and worked just as easily as normal expanded metal mesh. More particularly, the expanded metal mesh in accordance with the invention has a uniform smooth surface with no risk of snagging, as is the case, for example, with an expanded metal mesh in accordance with EP 0 797 486 in which nodes in the mesh are parted by a nick perpendicular to the actual expanded cut.

The mesh in accordance with the invention can be filled out or coated with curing or elastomeric polymerizing or dry substances or compounds and thus are useful e.g. as lathing as well as in roofing applications as products having become popular as "lead replacements". Further possible applications include:

1. spacers for cavity claddings,
2. tailored packings for spherical objects and the like,
3. drying grids and filter cages for industrial and domestic purposes,
4. mattings as employed in automotive repair as a replacement for glass-fiber plastics.

Further applications are conceivable in which forces need to be absorbed in an overload situation such as e.g. in guards on rotating machines or highway safety fencing.

It is good practice to configure the nodes in the mesh in accordance with the invention as a regular sequence of designed break points, by, for example, making every second or two from three nodes a designed break point staggered from row to row in the mesh.

Another variant consists of configuring the mesh, at least in localized portions thereof, throughout with designed break points, whereby marginal zones may be configured without designed break points to prevent unwanted tearing. To increase the stability and strength such meshes may be connected to each other at an angle and more particularly at right angles and at the junctions.

The mesh in accordance with the invention including some nodes configured as designed break points is also combinable with an expanded metal having an improved expansion response in accordance with DE 198 21 574.6. Starting with trapezoidal, corrugated or similar shaped sheet metal the nicks are incorporated in the mesh so that selected links remain connected to each other only by ultrathin locations to thus form the designed break points. The junctions at these modes configured in the mesh as designed break points are, however, sufficiently rugged to break only when shaping as specified is done.

The weakened designed break nodes in the mesh may be produced with a conventional tool by setting a deeper cutting depth already during manufacture, although such a conventional tool may be used, however, to produce only designed break nodes throughout in the complete mesh.

Should, however, designed break points be required only in a regular sequence, for example only at every second or third node, this can be done with a tool having differingly deep gullets, such a tool producing in a "normal" cutting depth simultaneously conventional nodes and designed break nodes at the locations with less deep gullets. Instead of designed break nodes, a smooth parting of some nodes may result with less deep gullets in obtaining a mesh as set forth in EP 0 797 486, i.e. a mesh in which every second and/or third node is parted staggered from row to row of the mesh, resulting in a mesh which can be excellently formed spherical.

BRIEF DESCRIPTION OF THE DRAWINGS

The invention will now be detailed with reference to the attached drawings in which.

DETAILED DESCRIPTION

Figure 1:
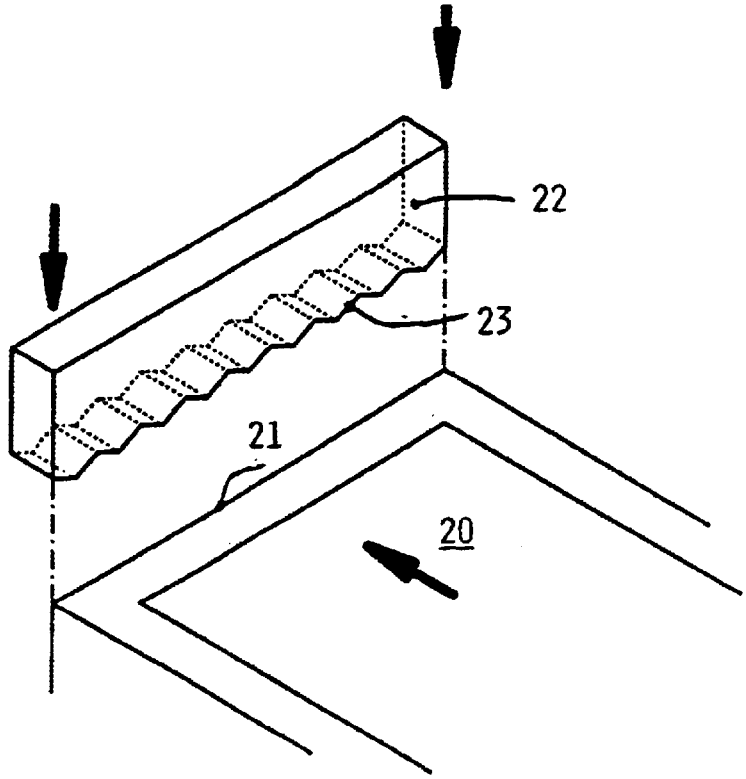
FIG. 1 is a diagrammatic side view in perspective of how an expanded metal mesh is produced.
Figure 1:
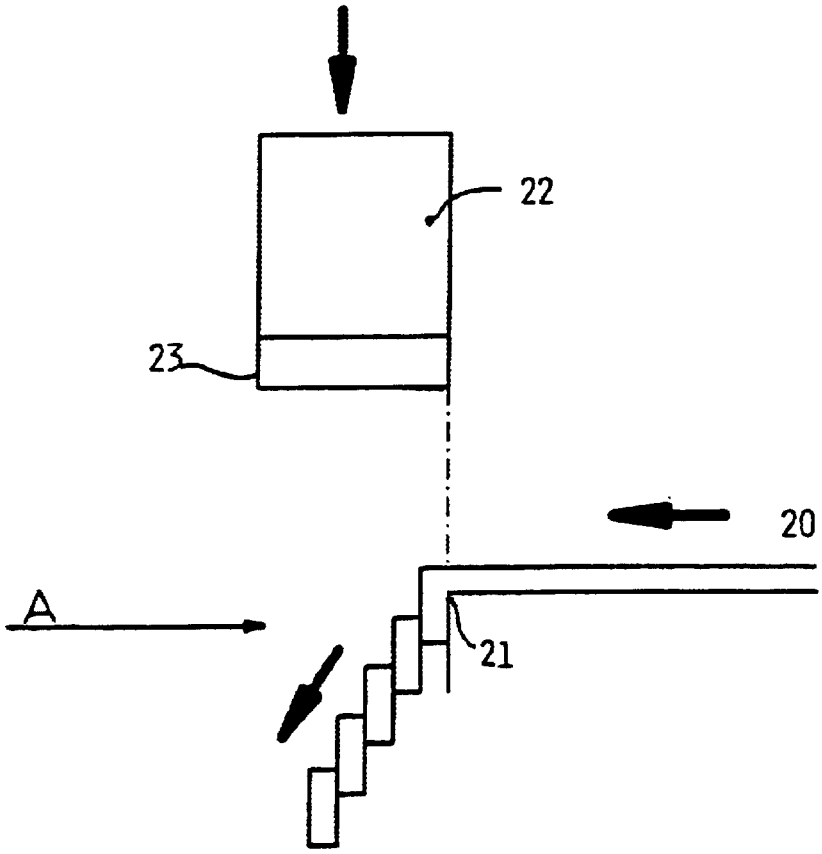

Referring now to FIG. 1 there is illustrated how an expanded metal mesh is conventionally produced. The sheet metal 20 to be expanded is advanced incrementally over a cutting edge 21 forming a bottom blade. A top blade 22 having a toothed face 23 is lowered on to the sheet metal strip advanced over the cutting edge 22. The top blade 22 slits the sheet metal 20 along the cutting edge 21 and simultaneously slantingly downsweeps the protruding sheet metal strip, in simultaneously expanding it, to form a half-mesh. On the next increment, the top blade is lowered by e.g. half a mesh width laterally staggered to thus complete the mesh.

Known types of tools for this purpose produce expanded metal mesh comprising, with no exception, solid nodes, or nodes differingly solid to only a slight degree, with straight links inbetween, or links slightly corrugated at the most in producing a festooned mesh. In all of these prior art expanded metal meshes, including those having regular/asymmetrical mesh shapes, the spacing between the individual nodes cannot be systematically varied, due to the de facto straight links. It is precisely this ability to vary the node spacing for the purpose of shaping also localized portions in the mesh with substantially more freedom, e.g. spherically or hyperbolic whilst avoiding unwanted deformation of adjoining mesh portions, that is of decisive significance and now available cost-effectively for the first time by tools modified in accordance with the invention.

Figure 4:
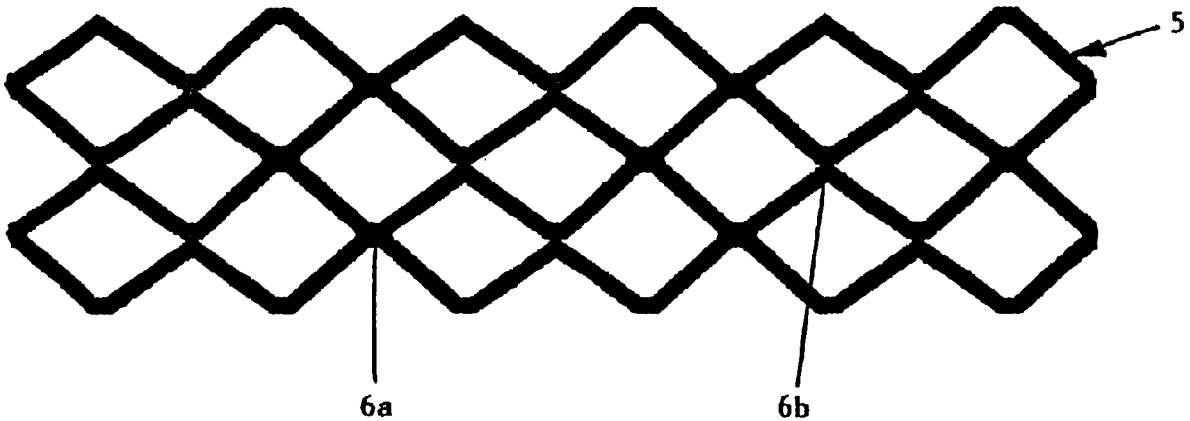
FIG. 4 is an illustration of an expanded metal mesh comprising an alternating arrangement of normally connected links and near-parted links as produced by a shear blade as shown in FIG. 2.

Producing an expanded metal mesh in accordance with the invention is made possible by gulleting the shear blade differingly deep. One such shear blade 1 having teeth 2 is evident, diagrammatically from FIG. 2. Whilst the tips 3 are all the same, only every second gullet 4*a* is configured as wide as the tips 3, the remaining gullets 4*b* being configured less deep and narrower to thus permit production of an expanded metal mesh 5 as shown in FIGS. 3 and 4 having alternatingly normally connected links 6*a* and near-parted links 6*b* (designed break points).

Figure 5:
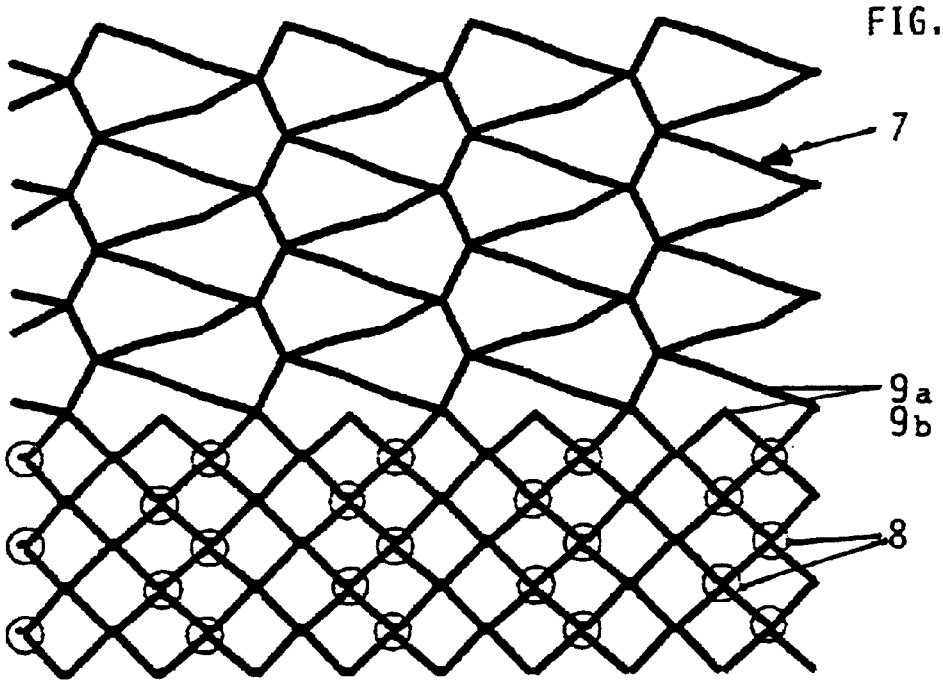
FIG. 5 is an illustration of an expanded metal mesh corresponding to that as shown in FIG. 4 but in a partly expanded condition.

Referring now to FIG. 5 there is illustrated a similar expanded metal mesh 7 shown portionally expanded, the circles 8 designating near-parted links 6*b* and the points 9*a* and 9*b* designating a formerly contiguous node. Due to the mesh being enlarged an expansion of app 35% is achieved without crosswise contraction.

Figure 6:
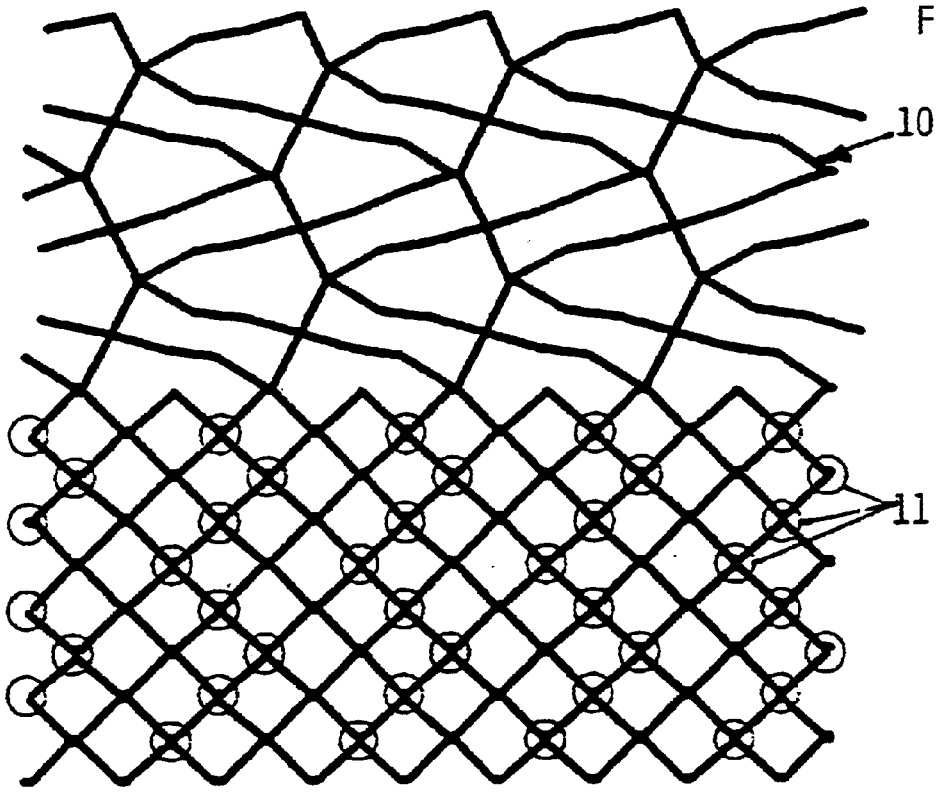
FIG. 6 is an illustration of one variant of an expanded metal mesh produced by another blade action, likewise shown in partly expanded condition.

Referring now to FIG. 6 there is illustrated a similar expanded metal mesh 10 involving a different blade action by it being moved twice to the right and twice to the left respectively in each case, as is evident from the circles 11 designating the designed break points.

Figure 7:
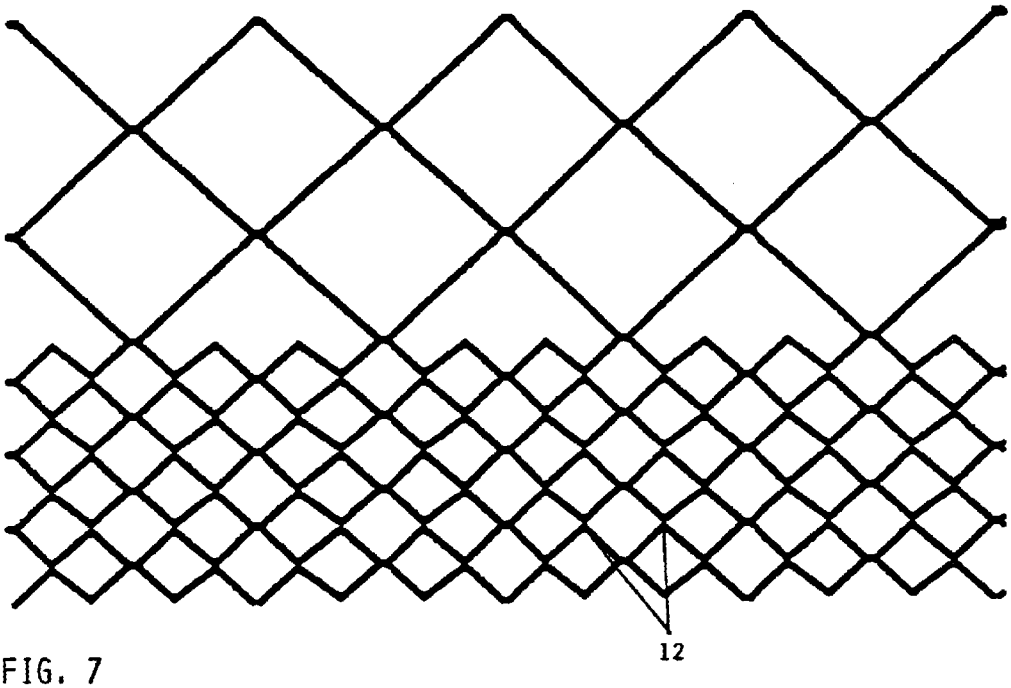
FIG. 7 is an illustration of an expanded metal mesh in which two of three links in each case are configured as designed break points.

Referring now to FIG. 7 there is illustrated how near 100% expansion is achievable when two from three links in each case are configured as designed break points 12.

Figure 8:
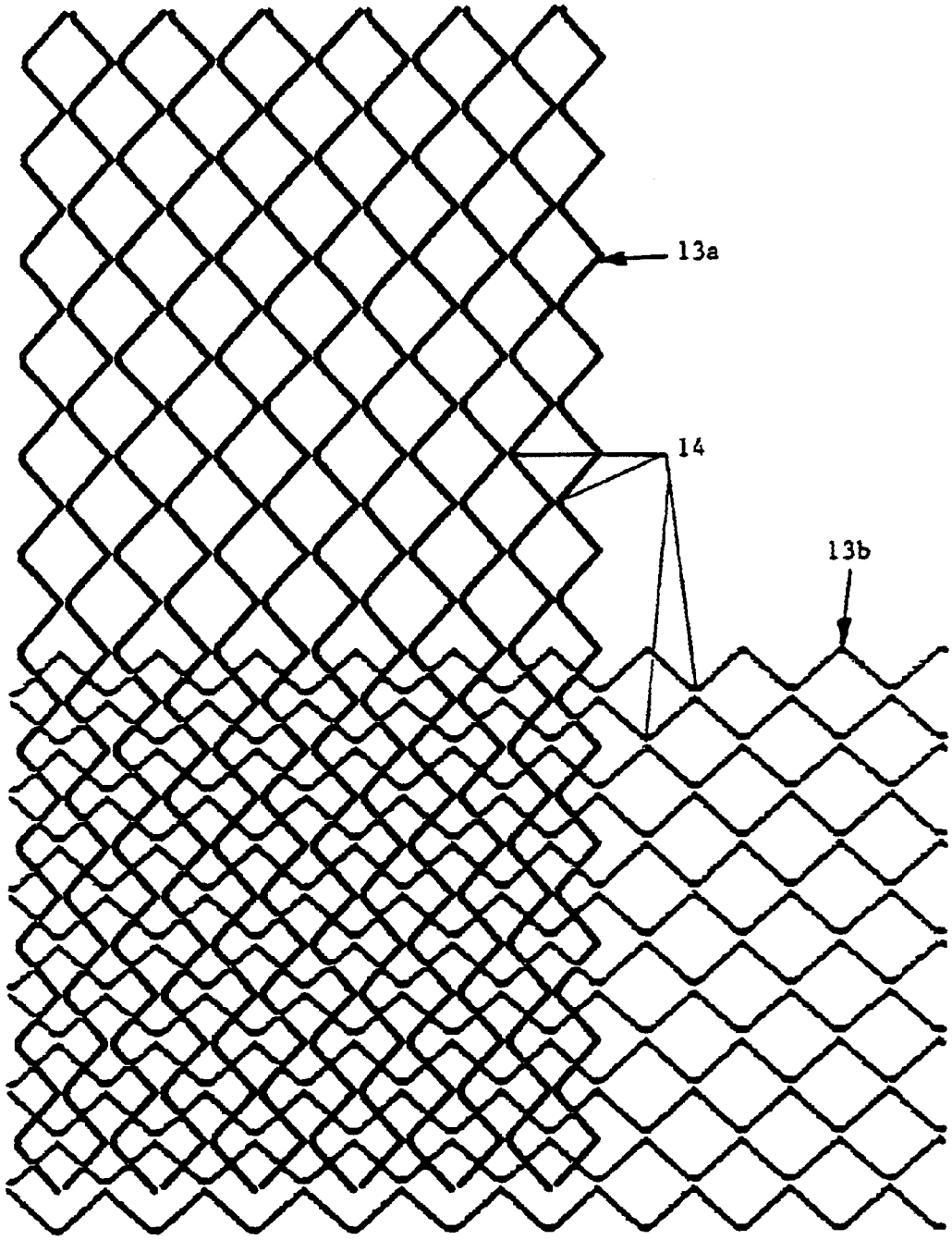
FIG. 8 is an illustration of two expanded metal meshes each placed on the other at right angles, configured throughout with designed break points.

Referring now to FIG. 8 there is illustrated in conclusion a sandwich arrangement of two expanded metal meshes 13*a* and 13*b* each placed on the other at right angles, configured with designed break points 14 throughout or intermittently.

The sandwiched meshes may be cemented together by a potting compound.

With reference to FIGS. 2 to 8 the invention has been described in conjunction with expanded metal mesh. However, the invention lends itself in principle to any type of perforated sheet metal. For instance, the expanded metal meshes 13*a* and 13*b* as shown in FIG. 8 could also be produced from perforated sheet metal with near-square perforations and incorporating designed break points 14.

Figure 2:
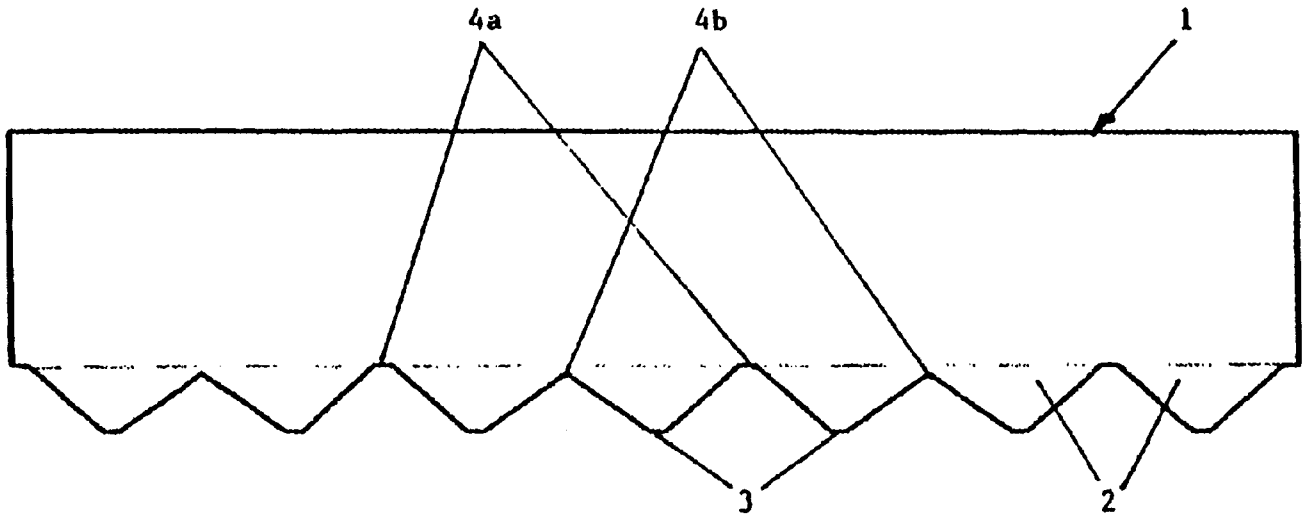
FIG. 2 is a diagrammatic view of a shear blade gulleted differingly in depth for producing an expanded metal mesh in accordance with the invention.
Figure 3:
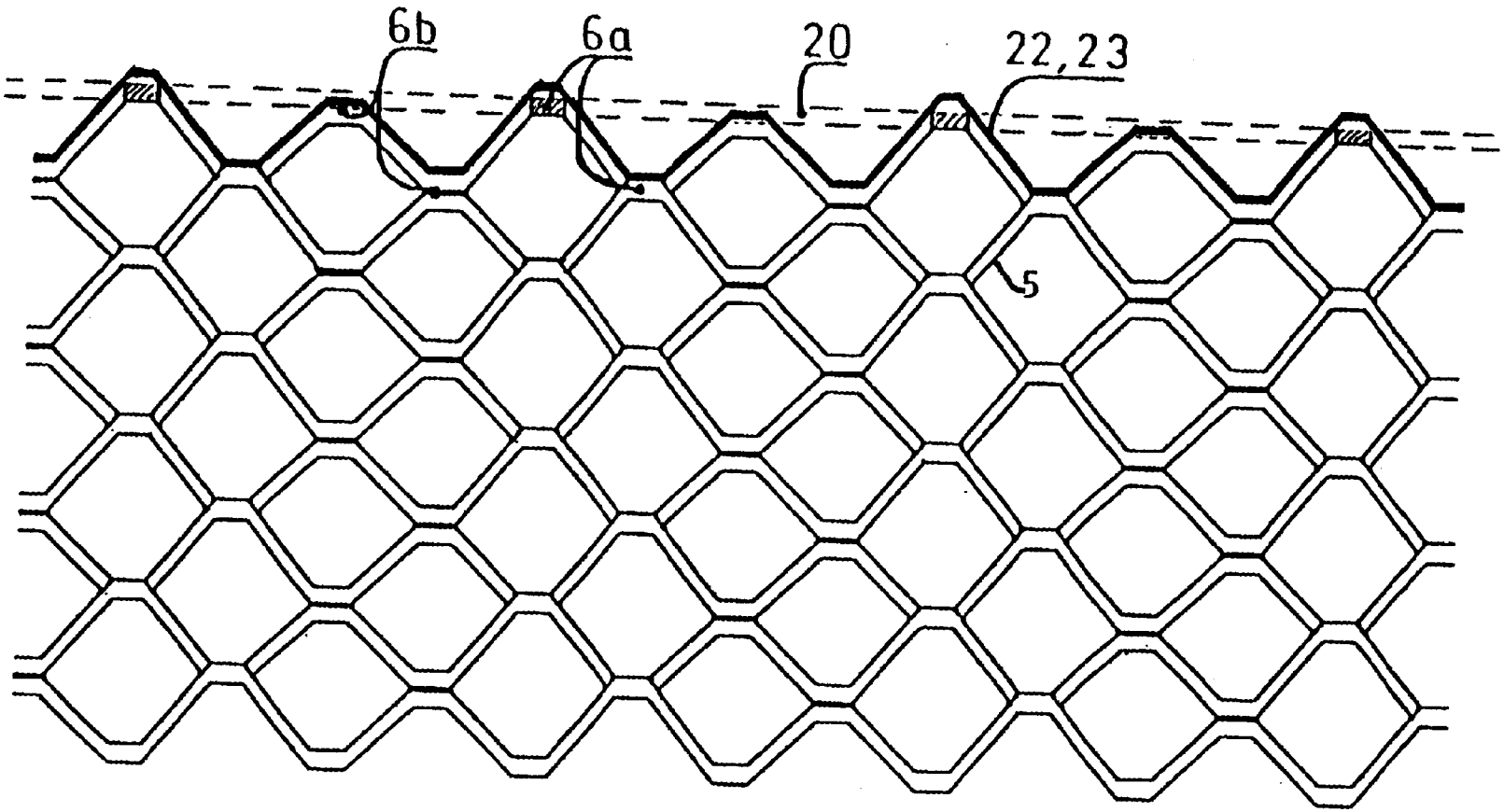
FIG. 3 is a diagrammatic view in the direction A as shown in FIG. 1 illustrating manufacture of an expanded metal mesh with a tool as shown in FIG. 2.

FIGS. 2 and 3 depicted one variant of the shear blade for producing expanded metal mesh in accordance with the invention.

Tools having one or more of the aforementioned features now permit for the first time cost-effective manufacture of expanded metal mesh for a high degree of three-dimensional conformability incorporating remaining solid nodes and angled links joining the latter for the purpose of varying the node spacing systematically activatable.

What is claimed is:

1. An expanded metal mesh comprising a network of mesh links and mesh nodes, wherein the nodes are in a plurality of rows that extend in a first direction and the rows are spaced apart in a second direction, which is transverse to the first direction, and wherein some of the nodes in a row are configured as break points, such as to rupture on application of a predetermined tension to the mesh, and some of the nodes in said row are configured to withstand said predetermined tension without rupturing.

2. An expanded metal mesh according to claim 1, wherein the nodes that are configured as break points are distributed in a regular pattern.

3. An expanded metal mesh according to claim 2, wherein every second node in a row is configured as a break point and the break points in successive rows are staggered.

4. An expanded metal mesh according to claim 2, wherein, in a given row, two nodes out of three are configured as break points and, in successive rows, the groups of three nodes are staggered.

5. An expanded metal mesh according to claim 1, wherein nodes that are configured as break points are confined to a region of the mesh.

6. An expanded metal mesh according to claim 1, formed from a sheet of corrugated or trapezoidal metal.

7. An expanded metal mesh according to claim 1, formed from a sheet of perforated metal.

8. An expanded metal mesh according to claim 1, wherein, in each of first and second successive rows, first and second nodes in each sequence of three nodes are configured as break points and the third node in the sequence is configured to withstand said predetermined tension without rupturing, and the third node in each sequence of three nodes in the first row is staggered from the third nodes in the sequences of three nodes in the second row.

9. An expanded metal mesh according to claim 1, having a first region containing nodes that are configured as break points and a second region containing only nodes that are configured to withstand said predetermined tension without rupturing.

10. An article of manufacture comprising:

a first expanded metal mesh comprising a network of mesh links and mesh nodes, wherein the nodes are in a plurality of rows that extend in a first direction and the rows are spaced apart in a second direction, which is transverse to the first direction, and wherein some of the nodes in a row are configured as break points, such as to rupture upon application of a predetermined tension to the mesh in said second direction, and some of the nodes in said row are configured to withstand said predetermined tension without rupturing, and a second expanded metal mesh comprising a network of mesh links and mesh nodes, wherein the nodes of the second mesh are in a plurality of rows that extend in a third direction, which is inclined to the first direction, and the rows of nodes of the second mesh are spaced apart in a fourth direction, which is transverse to the third direction, and wherein the first and second meshes are in overlapping relationship.

11. An article according to claim 10, wherein some of the nodes in a row of the second expanded metal mesh are configured as break points, such as to rupture on application of said predetermined tension to the second expanded metal mesh, and some of the nodes in said row of the second expanded metal mesh are configured to withstand said predetermined tension without rupturing.

12. An expanded metal mesh comprising a network of mesh links and mesh nodes, wherein at least some of said nodes are configured as break points designed to rupture on strain of said mesh, and wherein two meshes configured continuous or intermittent with designed break points are placed on the other at an angle.

13. An expanded metal mesh according to claim 12, wherein said nodes are configured in a regular sequence as designed break points.

* * * * *